United States Patent [19]

Ljungcrantz

[11] 4,094,124

[45] June 13, 1978

[54] PROCESS AND APPARATUS FOR THE MANUFACTURE OF FILLED, CLOSED CONTAINERS

[75] Inventor: Billy Ljungcrantz, Chatel-St.Denis, Switzerland

[73] Assignee: La Coulaz, Switzerland

[21] Appl. No.: 763,139

[22] Filed: Jan. 27, 1977

[30] Foreign Application Priority Data

Jan. 27, 1976 Switzerland ..... 999/76

[51] Int. Cl.[2] ..... B65B 1/02; B65B 3/02

[52] U.S. Cl. ..... 53/29; 53/141; 53/183; 93/44.1 R; 93/55.1 R

[58] Field of Search ..... 53/29, 141, 183, 192, 53/185; 93/44.1 R, 55.1 R, 55.1 P

[56] References Cited

U.S. PATENT DOCUMENTS

| | | | |
|---|---|---|---|
| 2,180,954 | 11/1939 | Harrison | 53/185 X |
| 3,507,095 | 4/1970 | Kuhnle | 53/183 |
| 3,559,369 | 2/1971 | Buchner et al. | 53/183 |

*Primary Examiner*—Robert Louis Spruill

*Attorney, Agent, or Firm*—Lowe, King, Price & Markva

[57] ABSTRACT

The invention concerns the production of closed containers filled with a liquid or particulate material. Production takes place on a machine having two tiers revolving about a common, stationary shaft. The container wall is shaped from a blank and then welded and the container bottom fitted in the upper tier. The container is filled shortly before or during its transfer to the lower tier where the lid is fitted and the finished product swung out onto a conveyor belt.

24 Claims, 14 Drawing Figures

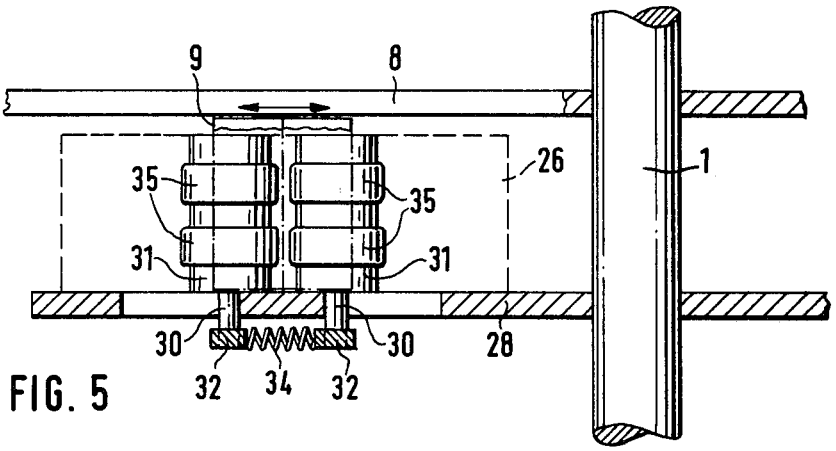
FIG. 5
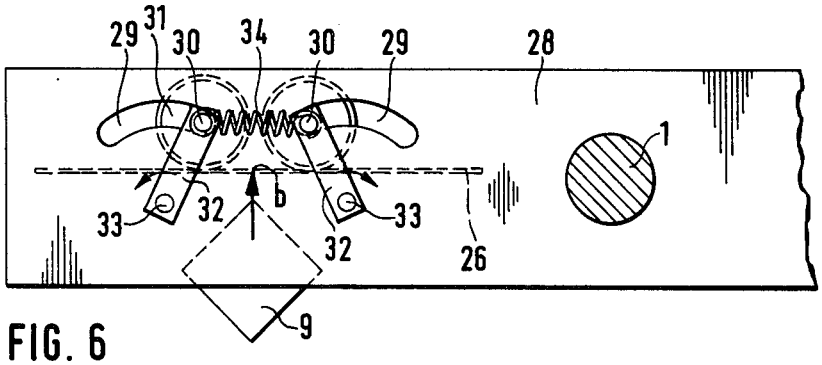
FIG. 6
FIG.7
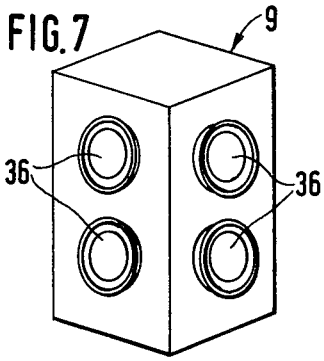
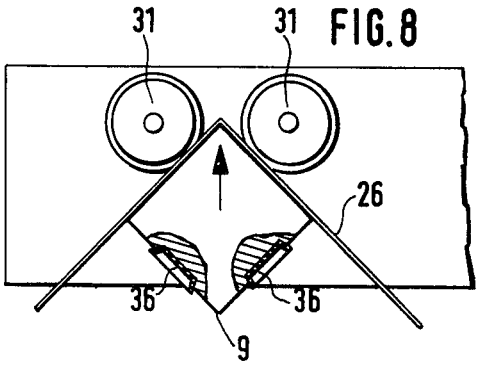
FIG.8

PROCESS AND APPARATUS FOR THE MANUFACTURE OF FILLED, CLOSED CONTAINERS

BACKGROUND OF THE INVENTION

The invention relates to a process and apparatus for the manufacture of filled, closed containers made of a foldable material and having a tubular wall section of any cross-section, a bottom and a lid, the material for the wall section, the bottom and the lid being fed in separately and the container being filled and closed with the lid after fixing the bottom in place.

A particular, but in no way exclusive area of application of the invention is the manufacture of milk cartons which are assembled, filled and closed on the apparatus itself under hygienic conditions.

Prior art processes and machines hitherto used for manufacturing tubular cardboard or plastic containers and still in use today have several stations arranged in cadence to form a production line to which the container blanks are fed at intervals by a transport system. Owing to the large number of stations, these known machines are very long and occupy a relatively large space. Since the joints in the material are mostly made by welding (heat-sealing), each welding station must be followed by a cooling leg. This considerably increases the total length of the machine. In addition, these machines working in a production line do not allow continuous manufacture and the moving parts of the machinery cannot be sealed off from the zone in which the containers are formed and filled, although this is desirable for reasons of hygiene. However, depending on the contents of the containers, it can be of the utmost importance that the sterilized contents do not come into contact with machine oil or dust particles and also that the moving parts of the machinery are protected from the container contents which may at times spray in all directions.

SUMMARY OF THE INVENTION

The object of the present invention is therefore to propose an apparatus for manufacturing filled, closed containers which does not suffer from the disadvantages mentioned above. The new process and the associated apparatus are intended to allow filled, closed containers to be manufactured continuously, and also when required intermittently, at high production rates and in a very small space. According to the invention, this is achieved by arranging that all the necessary process steps, in particular the shaping and welding of the tubular wall section and the attaching of the bottom and lid, take place in at least two rotating tiers positioned at different levels, the process beginning in one rotating tier and the container blank then being transferred to another tier rotating about the same axis where the blank is further processed or finished.

In a preferred embodiment of the invention, the tubular wall section is shaped and welded and the container bottom fitted in a first tier, while the container lid is fitted in a tier situated below the first.

The product with which the container is to be filled is preferably introduced shortly before or during the transfer of the unfinished container from the first tier where the bottom is attached to the lower tier.

The apparatus for carrying out this process has a number of processing stations, carrier elements for transporting the container blank from one station to the other and tools for shaping the tubular wall section, welding the wall section longitudinally, fitting the bottom, introducing the contents and fitting the lid.

The apparatus of the invention is characterized in that the processing stations are located about a common, stationary shaft in at least two tiers situated at different levels. The carrier elements and the processing tools are driven by means which cause all the carrier elements to execute a rotational motion or a series of intermittent partial rotations about said shaft and cause all the processing tools to execute about the same axis at least a partial rotation through the angle corresponding to their respective work sector.

The carrier elements are conveniently mandrels suspended in the upper tier, said mandrels having the same shape as the tubular wall section and cooperating over a given sector with a device for welding the container blank longitudinally along a line substantially parallel to said shaft.

The carrier elements are preferably several holding and fitting heads working together in pairs and mounted substantially in two concentric circles at the upper ends of cam-driven rods which execute a vertical reciprocating motion, the holding and fitting heads of the outer circle being additionally pivotable about the longitudinal axis of their associated drive rod.

The apparatus is conveniently driven by two externally toothed drive wheels freely rotatably mounted on said shaft, the mandrels being mounted on one drive wheel and the drive rods on the other drive wheel so that both mandrels and drive rods are entrained by the rotation of the two drive wheels.

Rigidly connected to the lower drive wheel is preferably an internally toothed ring which drives an eccentric via a pinion, said eccentric driving the longitudinal seam welding device and means for preheating the container bottom and lid to execute an oscillatory motion.

The device for making the longitudinal weld is also conveniently connected via a lever system to a stationary cam such that the device periodically moves in the radial direction against the mandrel during its oscillatory motion about the shaft.

BRIEF DESCRIPTION OF DRAWINGS

The accompanying drawing shows an illustrative embodiment of the invention.

FIG. 5 is a front view of a device for shaping the tubular wall section.

FIG. 6 is a view from below of the device illustrated in FIG. 5.

FIG. 7 is a perspective view of a mandrel used with the invention disclosed herein.

FIG. 8 is a fragmentary plan view of a shaping device of the present invention.

DESCRIPTION OF SPECIFIC EMBODIMENTS

Figure 1:
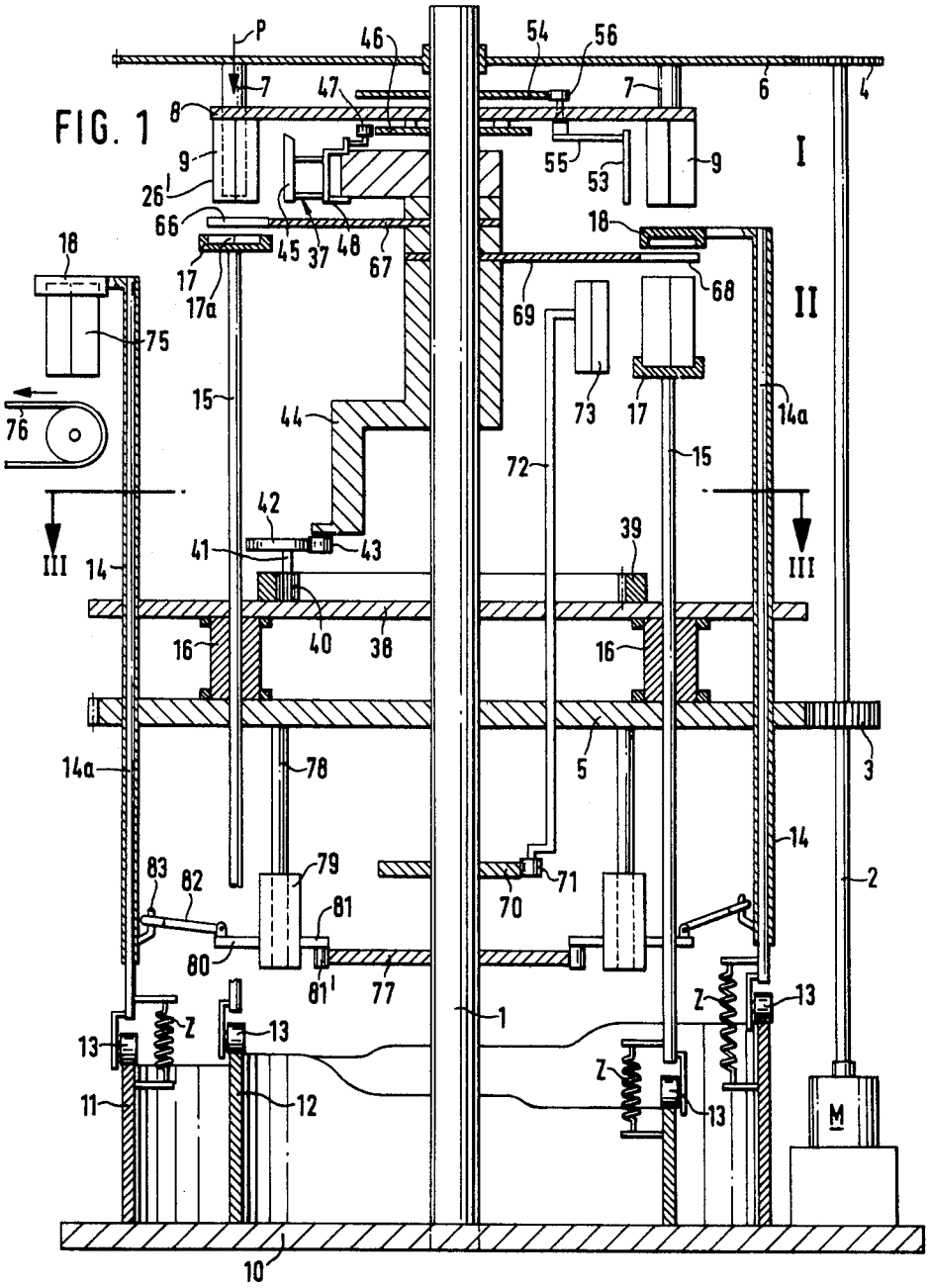
FIG. 1 is a schematic, very much simplified vertical section of a machine for manufacturing filled and closed parallelepipedal milk cartons.
Figure 2:
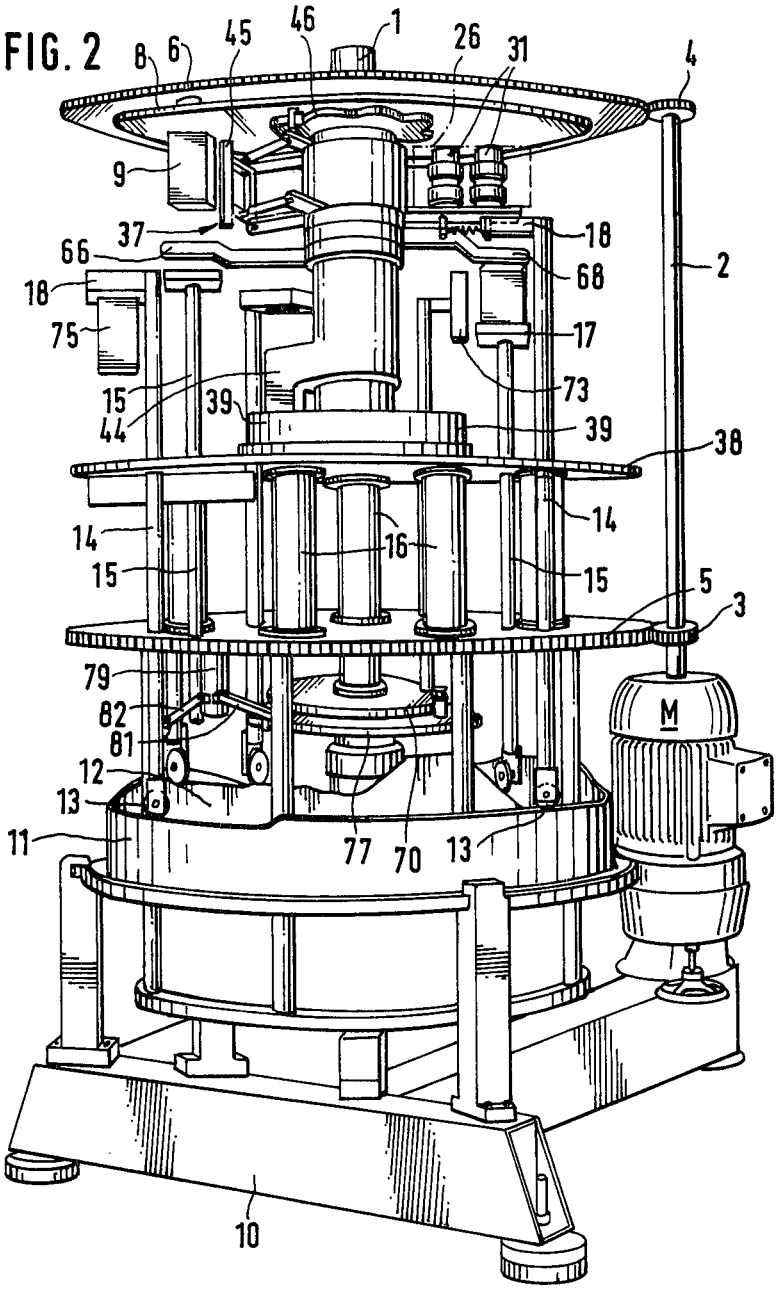
FIG. 2 is a simplified perspective view of the same machine.

In FIG. 1, the central component of the machine, a stationary, i.e. not rotating shaft, is denoted by the reference numeral 1. All the stations are disposed around this shaft 1 in two tiers I and II.

A motor M drives, via a shaft 2 and two pinions 3 and 4 and preferably by means of a reduction gear (not shown), two drive wheels 5 and 6 which are provided with peripheral teeth and which rotate together. A carrier plate 8 is connected to the upper drive wheel 6 by spacer sleeves 7 such that the carrier plate 8 is entrained by the drive wheel 6 as the latter rotates. Eight shaping mandrels 9 are mounted on the underside of the carrier plate 8, symmetrically distributed around the periphery of the plate. The shape of the mandrels corresponds exactly to that of the parallelepipedal cartons to be manufactured. The mandrels 9 rotate continuously and the various steps in the process are carried out during the continuous rotation. The individual operations and the devices necessary for them are described later.

Figure 3:
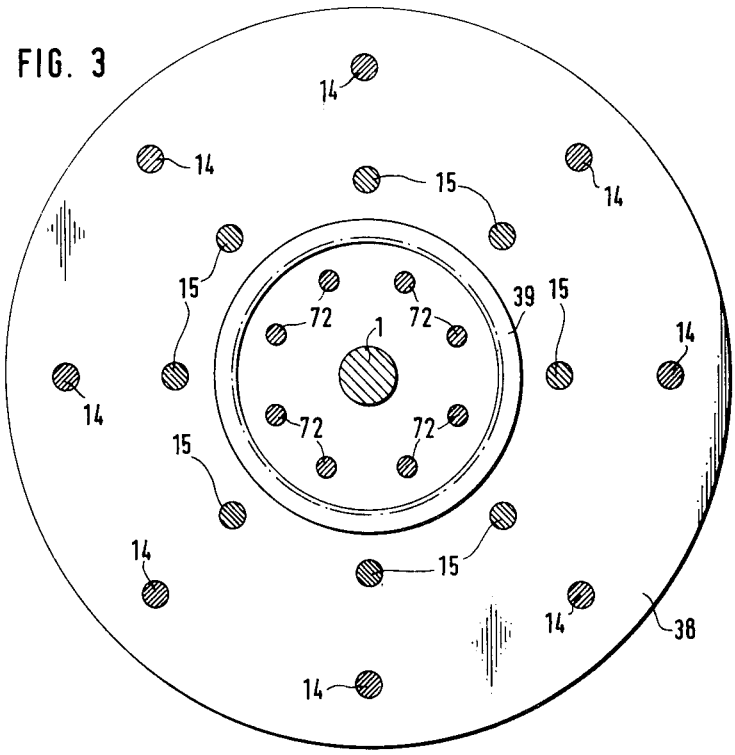
FIG. 3 is a simplified horizontal section along line III — III in FIG. 1.

On a base plate 10, two concentric, substantially cylindrical cams 11 and 12 are disposed, the upper edges of which have a given drive profile. Eight drive rods 14 and 15 (see also FIG. 3) which run on rollers 13 rest on each of the drive surfaces of the cams 11 and 12. There are therefore two groups of cam-driven rods 14 and 15, respectively, which pass through the drive wheel 5 and a carrier plate 38 connected to the drive wheel 5 by spacer sleeves 16. With the motor M running, all the rods 14,15 rotate about the shaft 1, executing additional vertical movements corresponding to the profiles of the cams 11 and 12.

The rollers 13 are kept in constant contact with the cams 11 and 12 by tension springs Z.

The upper end of each drive rod 15 in the inner circle carries an upwards facing bottom-fitting head 17 for applying the bottom to a previously formed container blank. The upper end of each rod 14 in the outer circle carries a downwards facing lid-fitting head 18 for applying the lid to a previously formed container blank which has already been provided with a bottom and filled.

The remaining constructional features of the machine are described below in conjunction with their functions so that they may be more readily understood. Thus the manufacturing process will now be described, in the course of which the constructional features of the machine not yet explained will be successively introduced.

Figure 4:
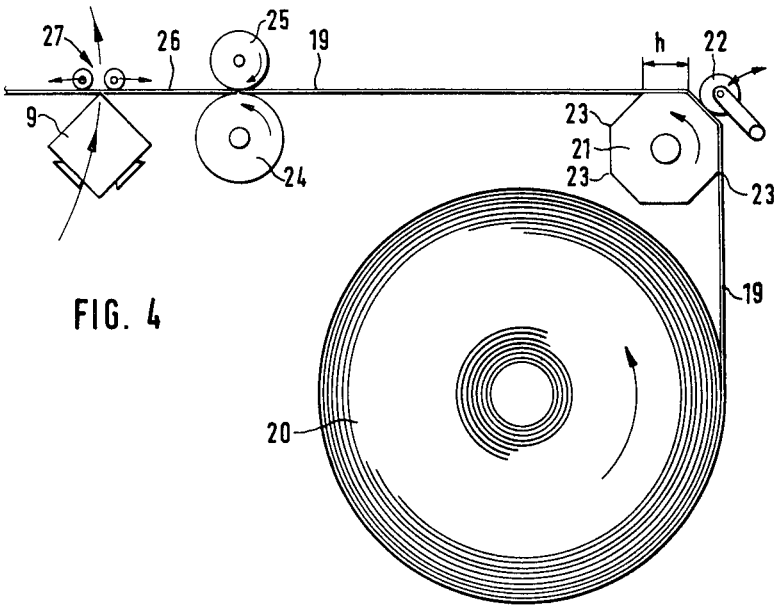
FIG. 4 is a plan view of the machine's wall section material feed equipment.

In the manufacture of a parallelepipedal milk carton the wall section must be produced first. FIG. 4 shows how a prescored strip 19 is wound off a delivery roll 20, guided by a pair of rollers 21,22. The cross-section of the actual guide roller 21 is a regular octagon, the sides h of which are so dimensioned that, as the guide roller 21 rotates, an edge 23 coincides with the prescored fold lines of the plastic strip. It is, of course, important for these cooperating parts to be accurately manufactured and precisely adjusted before container production begins. The pressure roller 22 must be mounted elastically so that it can follow the profile of the rotating guide roller 21.

Figure 5A:
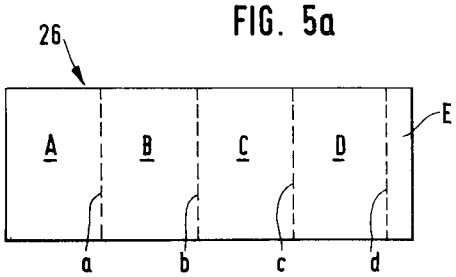
FIG. 5*a* shows the pre-cut plastic blank fed to the device depicted in FIG. 5.

A rotating blade 24 operating in conjunction with a similarly rotating counter-roller 25 cuts the strip 19 into sections. The length of these sections corresponds to the periphery of the finished carton wall including a welding flap E (FIG. 5*a*). The separated blank, designated by the reference numeral 26, is then fed to the shaping device 27 the construction of which is illustrated in FIGS. 5 to 8.

The blank 26 is shown in FIG. 5*a*. It has four score lines *a, b, c* and *d* dividing it into the four walls A, B, C, D of the finished parallelepipedal carton. As already mentioned, it also has an overlap section E used in forming the longitudinal weld.

One advantage of the present process is that the score lines *a, b* and *c* are not essential and must only be provided when relatively unpliable materials are used.

The task of the shaping device 27 (FIG. 4) is to shape the parallelepipedal carton wall. This device has a stationary plate 28 (FIGS. 5 and 6) provided with two curved, longitudinal slots 29. Projecting down into these longitudinal slots are the pilots 30 of two substantially cylindrical pressure rollers 31. As the view from below of FIG. 6 shows, the two pilots 30 are fixed to two guide links 32 which are pivotable about two stationary shafts 33 in the direction of the arrow. The return spring 34 constantly pulls the two pilots 30 back into their starting position shown in FIG. 6.

The two pressure rollers 31 are preferably rotatably mounted in the respective bores of the two guide links. The periphery of each pressure roller is provided with two pressure rings 35, a certain distance apart, made of a soft cushion-like material, e.g. a suitable plastic, and thus possess a certain resilience. It would however certainly also be possible to clothe the whole of the cylindrical wall of both rollers 31 with this resilient material.

The parallelepipedal mandrel 9 (FIG. 1) is, as already mentioned, mounted under the carrier plate 8. This mandrel is shown separately in FIGS. 7 and 8. Each of its rearwards facing walls carries two suction cups 36 made of plastic in the usual way which adhere when pressed against a plane wall by virtue of the vacuum so formed.

Figure 9:
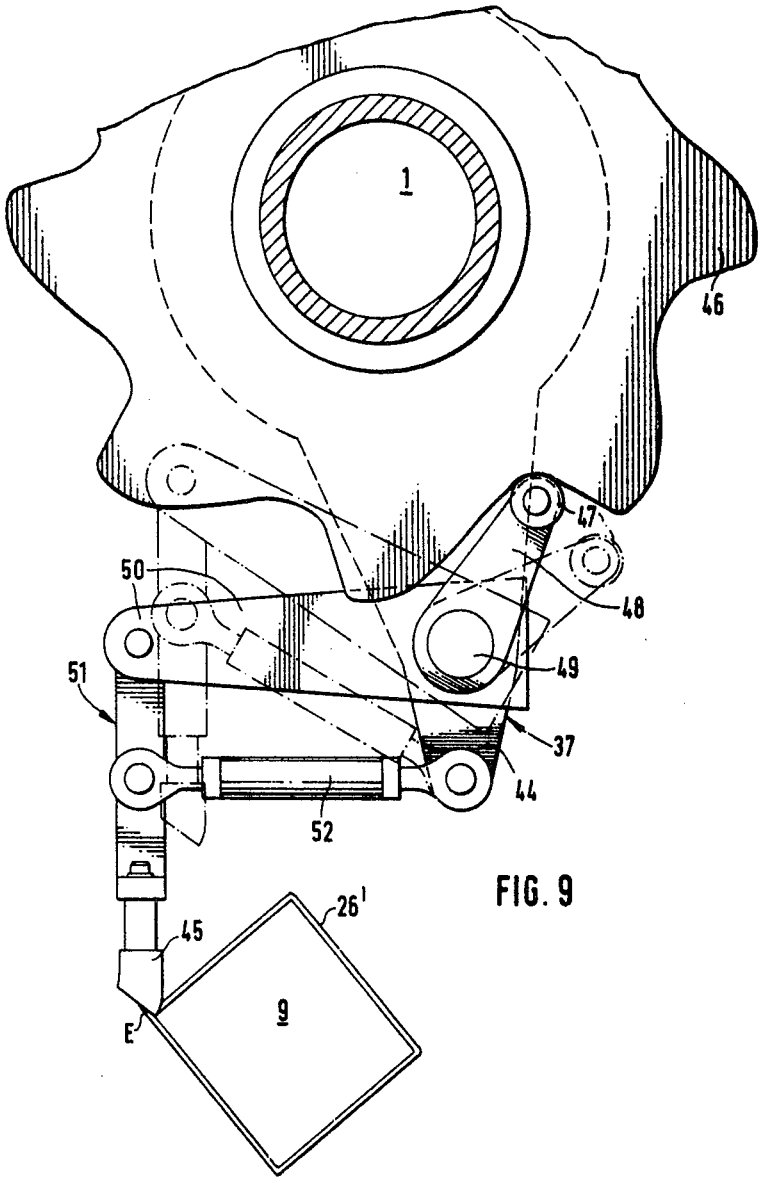
FIG. 9 is a fragmentary plan view of detail of a longitudinal seam welding device of this invention.

Before the prescored plastic blank 26 reaches the shaping device 27 it is standing on one edge (see FIGS. 4 and 5*a*). When the shaping device is in operation, the mandrel 9 moves, together with the seven other mandrels, about the shaft 1 and meets the central score line b of the blank 26 as shown by the arrow in FIG. 6. The plastic blank 26 is wrapped around the mandrel (see FIG. 8), the pressure rollers 31 and the spring 34 ensuring that the blank lies around the whole of the mandrel wall and in particular that the blank is pressed tight against the wall in the region of the suction cups 36. The two pressure rings 35 are located exactly at the level of the suction cups 36 which are themselves somewhat countersunk and can thus have no detrimental effect on the shaping operation. When the mandrel 9 has passed between the two pressure rollers 31, it takes with it the exactly positioned and already shaped carton wall, now denoted by 26' (FIG. 9).

The next operation involves the sealing of the still open longitudinal seam of the carton wall. Since in the embodiment chosen to illustrate the invention a polystyrene strip coated on both sides with homogenous polystyrene is used as the carton material, the seam is preferably sealed by heat treatment, i.e. heat-sealing or welding.

The device denoted as a whole by 37 (FIG. 1) is used to form the longitudinal seal. This device must execute the following movements:

(a) It must follow the rotational motion through a given angle,
(b) it must move radially outwards up against the rotating mandrel 9,
(c) it must draw back again from the mandrel 9, and
(d) it must finally return to its starting position.

This relatively complicated sequence of movements is achieved in the machine described by arranging that the device 37 is driven by the rotating lower drive wheel 5 to execute a reciprocating partial rotation, the radial movements being derived from the upper drive wheel 6 and superimposed on the reciprocating partial rotation.

Fixed on the carrier plate 38 is an internally toothed ring 39 in constant contact with a stationary pinion 40. Connected to the pinion 40 by the shaft 41 is an eccentric 42 which drives a follower 43 mounted on a swing arm 44. The swing arm 44 is mounted for free rotation on the shaft 1 and thus executes a periodic oscillating motion determined by the shape of the eccentric 42. This oscillating motion is transmitted to the longitudinal seam welding device 37.

The periodic radial motion of the device 37 which presses the heating bar 45 against the mandrel 9 is transmitted via a stellate cam 46 which rotates with the carrier plate 8. A cam follower 47 held continuously against the driving surface of cam 46 by a spring (not shown) transmits the periodic oscillating motion to the heating bar 45 via a lever system.

Figure 10:
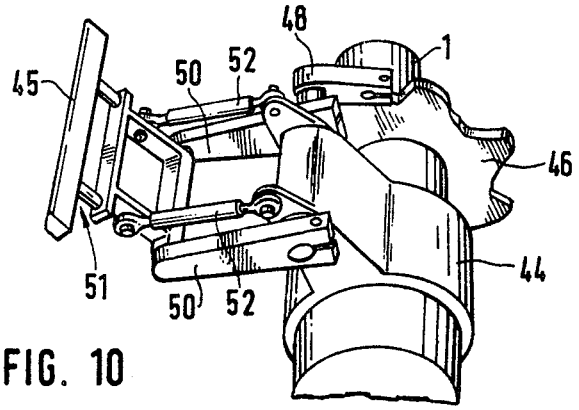
FIG. 10 is a perspective view of the device shown in FIG. 9.

The details of the longitudinal seam welding device 37 are shown in FIGS. 9 and 10. FIG. 9 is a simplified plan view of the device, FIG. 10 a perspective view.

The periodic oscillating motion originating from cam 46 is transmitted to a lever 48 through the follower 47 located at the end of lever 48. Lever 48 is rigidly connected by a shaft 49 with a second lever 50 at the far end of which a frame 51 carrying the heating bar is hinged. Two guide links 52 engage with this frame 51, the other ends of the guide links 52 being pivotably connected to the continuously reciprocating swing arm 44.

Depending on the intricacy of the required motion of the heating bar 45, several cooperating cams may be used instead of the single cam 46. In this way it would in particular be possible to ensure that the pointed edge of the heating bar 45 could be withdrawn from the overlap after heating it without deforming the overlap.

In FIG. 9 the operational position of device 37 is indicated by solid lines, the stand-by position by dot-and-dash lines.

Immediately after the longitudinal carton wall seam has been heated, the heated overlap E must be pressed against the neighboring region of the carton for a short time. This is done by means of a pressure bar 53 (FIG. 1) which rotates with its associated mandrel 9, is pressed at the correct moment up against the mandrel and withdrawn after a given period of time. The pressure bar is driven by a cam 54 (FIG. 1) rigidly fixed on shaft 1. As the carrier plate 8 rotates, a lever system 55 connected to the pressure bar 53 rotates with the carrier plate, a cam follower 56 driven by cam 54 being mounted at the upper end of lever system 55.

Figure 11:
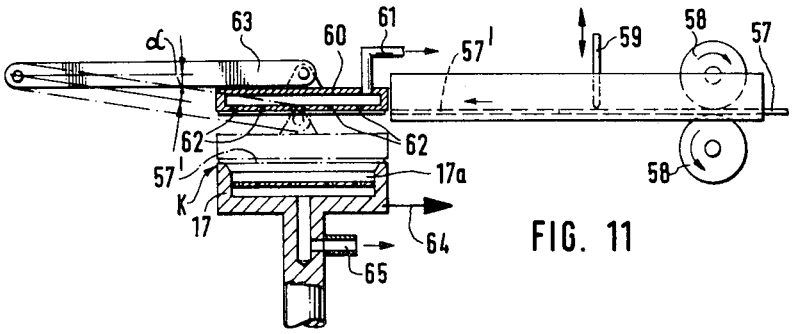
FIG. 11 is an elevational view partially in section of a bottom fitting device of this invention.

The welding of the longitudinal seam in the carton wall is thus completed and after a given cooling time the bottom of the carton must now be attached. The bottom is attached by means of the bottom fitting heads 17 already mentioned, to which the pre-cut bottom blank must however first be fed. The device developed for this purpose is shown in FIG. 11.

The strip 57 wound off a supply roll is advanced in the direction of the arrow at intervals by two rollers 58 and cut into square blanks 57' by a blade 59. The bottom blanks 57' are subsequently pushed on in the direction of the arrow until they reach the underside of a feed head 60 which is connected to a vacuum line by connecting pipe 61 and is provided with bores 62 in its underside. The feed head 60 is also pivotably mounted on an arm 63 which can pivot through an angle $\alpha$. When the feed head 60 has gripped a bottom blank 57', the head is lowered in time with the stroke of the machine and thus holds the blank ready to be stripped off and carried away by the slightly raised rear edge K of the passing bottom fitting head 17 (arrow 64). Fitting head 17 is connected to a vacuum line by a pipe 65 and carries away the bottom blank 57' securely held on the fitting head. The position of the device in which the bottom blank 57' is transferred to the fitting head 17 is shown in FIG. 11 by dot-and-dash lines.

When the bottom fitting head 17 (and this also applies of course to the other bottom fitting heads) has been loaded with the bottom blank 57', its continuous rotation brings it within the region of influence of a heater 66 (FIG. 1) mounted on a carrier arm 67 which oscillates periodically about shaft 1 with swing arm 44. Heater 66 thus accompanies the bottom fitting head 17 on its way between two stations, heating the bottom blank until the thermoplastic upper layer of the blank is softened. When carrier arm 67 has returned the heater to the immediately following bottom fitting head, bottom fitting head 17 is raised by rod 15 by virtue of the appropriate shape of cam 12, thus pressing the bottom blank over the lower end of the carton wall. As FIG. 11 shows, the bottom fitting head 17 has a recess **17*a* whose cross-section corresponds to that of the carton. The carton bottom is thus pressed tightly against the carton wall and the softened thermoplastic upper layer forms a tight joint. The recess 17*a* of the bottom fitting head 17** can be provided with movable shaping edges which improve the right-angle shape of the bottom in the usual way.

The bottom fitting head 17 now moves downwards, its suction effect stripping the lidless carton from mandrel 9. At the same time the contents, in the present embodiment milk, are introduced from above in the direction of arrow P through a bore in mandrel 9. The control of the filling operation in time with the working stroke of the machine is well-known to those skilled in the art and need not therefore be explained. At the same time as the carton is being filled, it is transferred from tier I to tier II where the remaining operations take place.

The filled carton must now be fitted with a lid. The feeding, preheating and fitting of the lid are carried out in a similar way to that of the carton bottom. The lid blanks arrive periodically at the lid fitting station and are transferred to the continuously rotating lid fitting heads 18 (FIG. 1) where the blanks are held by a suction effect. Here too, the blanks are preheated by a heater 68, fixed to an oscillating carrier arm 69. As with carrier arm 67, the oscillatory motion is derived from eccentric 42.

This oscillatory motion is of such a kind that the heater accompanies the lid fitting head 18 over a sector of the latter's rotation, thus softening the thermoplastic layer of the lid blank. The heater then returns to its starting position and the lid fitting head moves downward under the influence of cam 11 and a number of springs (not shown). The lid is shaped and at the same time pressed against the outside of the carton wall to form a tight weld.

Figure 12:
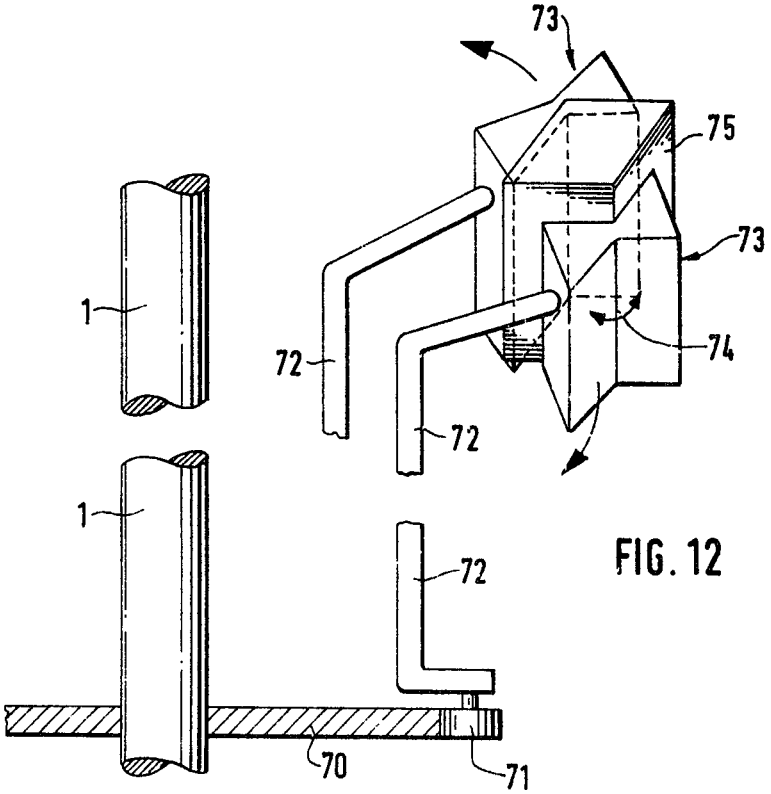
FIG. 12 is a fragmentary schematic view of a container holding device of this invention.

It should be noted however that when the lid is fitted the carton is no longer supported from inside by the rigid mandrel as it was when the bottom was fitted. The filled carton must therefore be laterally supported while the lid is being fitted. The device shown schematically in FIG. 12 may for instance be used for this purpose.

A stationary cam 70 (FIGS. 1 and 12) is fixed to shaft 1. A rod 72 which passes through carrier plate 38 and drive wheel 5 and therefore rotates continuously is provided at its lower end with a roller 71 kept in constant contact with the driving surface of cam 70 by a spring (not shown). The upper end of rod 72 is bent outwards and carries a gripper 73, the exact shape of which can be seen from FIG. 12. Each side of gripper 73 has a recess 74 which matches the right-angled edge of the carton so that the carton 75 can be securely gripped by two adjacent grippers 73. Since each gripper 73 has two recesses 74, appropriate design of cam 70 enables the grippers to be rotated through such an angle that each individual gripper works alternately with each of its two neighboring grippers. Thus with a total of eight stations in tier II, only eight grippers which can pivot from a central position to an operational position on either side are necessary.

The carton is now finished and only needs to be conveyed out of the circular assembly line. For this purpose, the eight outer rods 14 are mounted for rotation about their own vertical axis so that they can be rotated at the right moment to swing the carton outwards and deposit it on a waiting conveyor belt 76 by merely interrupting the suction effect or by means of a short blast of compressed air for instance.

The drive for rods 14 originates from a further stationary cam 77 (FIG. 1) fixed to shaft 1. A rod 78 fixed to and projecting down from the continuously rotating drive wheel 5 carries at its lower end a freely rotatable sleeve 79 on which two levers 80 and 81 are mounted so that they project radially outwards. One lever 80 is pivotably connected to a link rod 82 which in turn engages with a pivot pin 83 mounted on rod 14. The other lever carries a roller 81' which is held on the driving surface of cam 77 by a spring (not shown) and thus follows this cam. Appropriate design of cam 77 enables sleeve 79 to be rotated and this rotational motion to be transmitted to rod 14. Each of the eight rods 14 is provided with such a rotation mechanism 80 to 83. So that the rotation of rods 14 about their own axis is not transmitted to rollers 13, at least the lower part of rods 14 is designed as a tube, a rod **14*a* with roller 13** fixed to its lower end projecting upwards into this tube.

Delivery of the carton 75 onto the conveyor belt 76 brings the manufacturing cycle to an end. Rod 14 is rotated to bring its lid fitting head 18 in again and is ready for the next lid fitting operation.

Where only one machine component, e.g. a lid fitting head 18, has been described in the present text, it should of course be noted that the machine may have any number, e.g. 8, of these components which during the constant rotation pass from one processing station to the next, performing their functions. Hence the term "processing station" is not intended here to mean a concrete device but rather the sector in which a particular function is performed.

Summarizing for the sake of clarity, it can be seen that the machine described includes three separate moving systems.

(a) The lower rotating system based on the drive from drive wheel 5. This drive wheel causes the fitting heads 17, 18 and the grippers 73 to rotate about the main shaft and to swivel about the axis of their own support rods.

(b) The upper rotating system based on the drive from drive wheel 6. This drive wheel causes the mandrels 9, the pressure bars 53 and cam 46 to rotate as well as causing the reciprocating motion of pressure bars 53 (via cam 54 and follower 56).

(c) the oscillating system driven by the lower drive wheel via the toothed ring 39, the eccentric 42 and the swing arm 44. This drive causes the oscillation (reciprocating partial rotation) of device 37 for welding the longitudinal seam and of the heating members 66,68.

Figure 13:
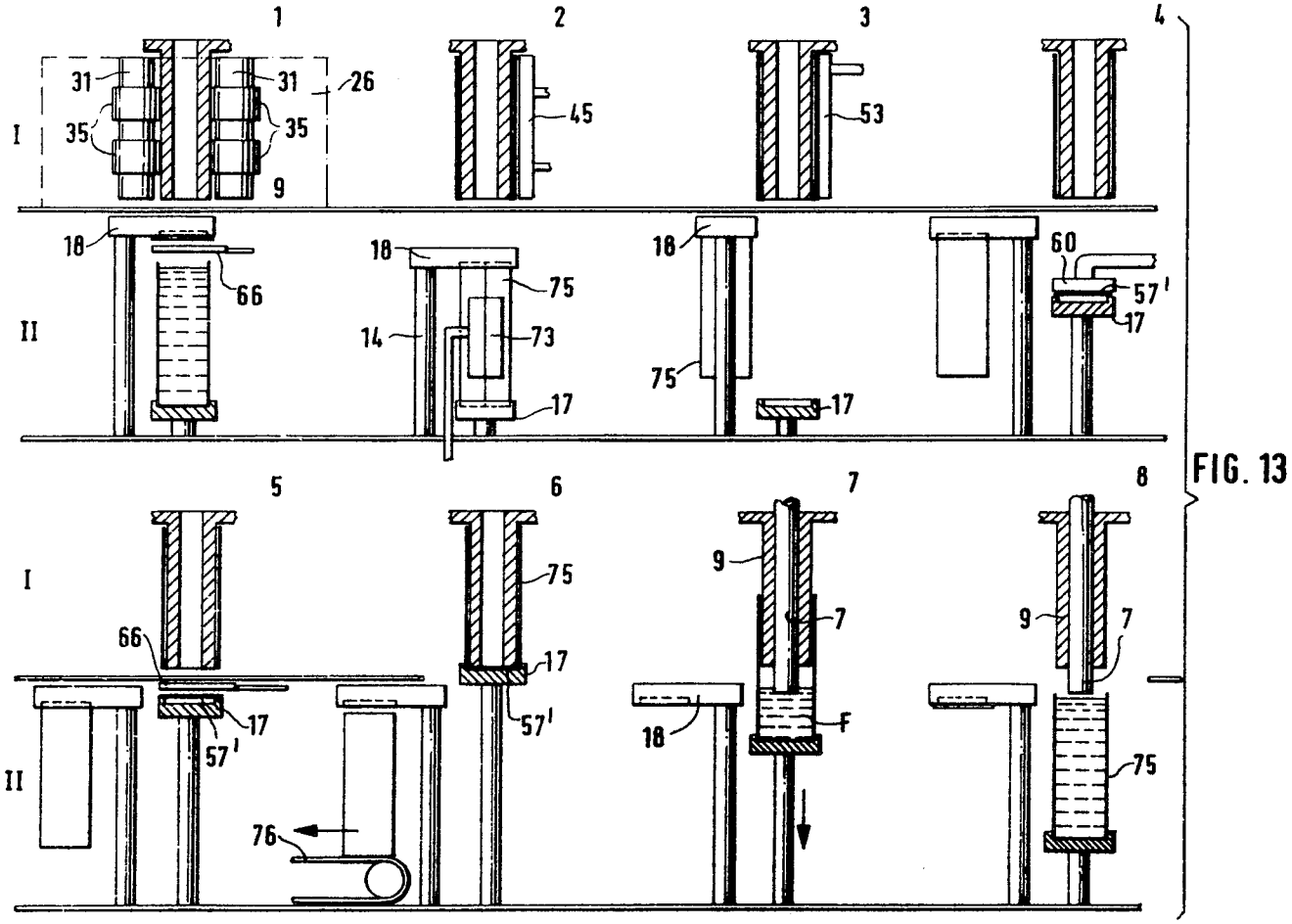
FIG. 13 illustrates by means of a flow diagram the various operations in the process.

The manufacturing process will now be characterized briefly in terms of the main operations (see FIG. 13), the individual stations being designated 1 to 8.

| Position | Operation |
|---|---|
| | **Tier I** |
| 1 | Shaping the wall section on the mandrel |
| 2 | Welding the longitudinal seam of the wall section |
| 3 | Pressing the longitudinal weld and letting it cool |
| 4 | Transferring the bottom blank to the bottom fitting head 60 from feed head 17 (FIG. 11), further cooling of the longitudinal weld |
| 5 | Heating the bottom blank and further cooling of the longitudinal weld |
| 6 | Fitting the bottom |
| 7 | Stripping the unfinished container from the mandrel and introduction of the contents F through the mandrel, cooling the bottom weld, transfer to tier II |
| 8 | Transfer of the lid blank to the lid fitting head, further cooling of the bottom weld. |
| | **Tier II** |
| 1 | Heating the lid blank |
| 2 | Fitting the lid, cooling the lid weld |
| 3 | Removal of the carton from the bottom fitting head, further cooling of the lid weld |
| 4 | Pivoting out the lid fitting head with the carton, transfer of the bottom blank onto the bottom fitting head 17 by means of the feed head 60, further cooling of the lid weld |
| 5 | Further cooling of the lid weld |
| 6 | Transfer of the carton to the conveyor belt 76, further cooling of the lid weld |
| 7 | Transfer of the unfinished container from tier I to tier II, initiation of the filling operation (milk) through the mandrel, further cooling of the lid weld |
| 8 | Introduction of the rest of the contents. |

The process may be fully automated and allows sufficient time after each welding operation for the weld to cool down without any special space or time having to be provided for this.

The machine components necessary for the individual process steps may be divided for the sake of clarity into carrier elements, tools or a combination of the two. It should be noted in this context that:

(a) the mandrels 9 are both carrier elements and tools since they both shape and subsequently carry the carton wall section, (b) the fitting heads which rotate about the axis of the machine and move up and down are both carrier elements and tools since they not only transport the container but also fit the bottom and lid.

(c) pure tools are in particular the device 37 for welding the longitudinal seam, devices 66,68 for heating lid and bottom and device 73 for supporting the filled carton while the lid is being attached, (d) there are no pure carrier elements.

The term "tubular wall section" used in the specification and claims means a linear hollow body with any cross-section, e.g. circular, square or rectangular.

For the manufacture of the carton a laminate material is preferred which has a substrate layer of expanded polystyrene coated on both sides with homogenous polystyrene.

The machine described is of course suitable for the introduction not only of liquids into containers but also of solids of all kinds such as powders, granulate materials or coarser solids such as biscuits etc.

The welding operations (the preheating of longitudinal seam, bottom and lid) are preferably carried out electrically, although a different heating method could be used, e.g. hot air. The melting point of homogenous polystyrene is about 140° C, so a heating temperature between 320° and 360° C would be suitable for the short heating of relatively thick material.

The embodiment described above should merely be viewed as an example which can be varied in many ways by those skilled in the art.

The drawing shows two heaters 66/68 displaced at 180° from each other. This angle depends of course on the number of preheating stations and may be calculated from the formula $(360°/n)$ where n is the number of preheating stations used.

The expressions "rotate" and "rotational motion" are intended to include motion which is not in a mathematically exact circle. This rotational motion may be continuous or intermittent, intermittent rotation being of use with non-liquid container contents in particular.

What we claim is:

1. In a process for manufacturing filled, closed containers made of a foldable material and having a tubular wall section of any cross-section, a bottom and a lid, wherein the material for the wall section, the bottom and the lid is fed in separately and the container is filled and closed with the lid after fixing the container bottom in place, the combination of process steps comprising:

(a) providing a first rotating tier located at a first level of operation, (b) providing a second rotating tier located at a second level of operation, and (c) effecting at least one of the operations of shaping and welding the tubular wall section and the attaching of the bottom and lid to said wall section in said first rotating tier and effecting the remaining operations in said second rotating tier.

2. A process as defined in claim 1 wherein said shaping and welding of the tubular wall section and the attaching of the bottom to the wall section is effected in said first rotating tier, and said attaching of the lid to the wall section is effected in said second rotating tier.

3. The process as defined in claim 2 wherein said second tier is located below said first tier.

4. The process as defined in claim 2 wherein the container blank made in said first tier is transferred to the said second tier while being rotated about the same axis of rotation.

5. A process as defined in claim 1 wherein the shaping and welding of the tubular wall section and the attaching of the bottom to form a container blank is effected in said first rotating tier, including the step of introducing the product with which the container is to be filled shortly before or during the transfer of the container blank from said first tier to the second tier which is located below said first tier.

6. The process as defined in claim 1 wherein said container blank material includes a thermoplastic material, and the process further includes the steps of preheating the container blank material used for the bottom and the lid before it is molded and attached onto the tubular wall section, said attaching step being effected while the wall section of the container blank is rotated through a given sector of rotation.

7. A process as defined in claim 6 wherein said preheating step is effected by a means which moves radially with respect to the rotating container blank inwardly and outwardly between a starting position and a working position.

8. A process as defined in claim 1 wherein said first rotating tier executes a circular motion about a vertical axis, and said container blank is further processed or finished in said second rotating tier, maintaining said first and second rotating tiers at the same speed of operation.

9. An apparatus for manufacturing filled, closed containers made of a foldable material and having a tubular wall section of any cross-section, a bottom and a lid, said apparatus comprising:

(a) means forming a plurality of processing stations, (b) carrier elements for transporting the container blank from one station to another, (c) tools for shaping the tubular wall section, (d) means for welding the wall section longitudinally, (e) means for fitting the bottom to said wall section, (f) means for introducing the contents of the material into the container blank, and (g) means for fitting the lid onto the container blank, (h) said processing station forming means being located about a common stationary shaft, in at least two tiers which are situated at different levels of operation, (i) first driving means to cause all the carrier elements to execute a rotational motion about said stationary shaft, and (j) second driving means to cause all the processing tools to execute at least a partial rotation about said stationary shaft through an angle corresponding to a respective work sector for each said processing tool.

10. An apparatus as defined in claim 9 wherein one of the tiers is located above the other tier, and said carrier elements comprise mandrels suspended in the upper tier, said mandrels having the same shape as the tubular wall section and cooperating over a given sector of rotation with said welding means which effects the welding of the container blank wall section longitudinally along a line substantially parallel to said stationary shaft.

11. An apparatus as defined in claim 9 wherein said carrier elements include several holding and fitting heads working together in pairs and being mounted in two concentric circles at the upper ends of cam driven drive rods, said drive rods being effective to execute a vertical reciprocating motion, said holding and fitting heads of the outer circle being additionally pivotable about the longitudinal axis of the associated drive rod.

12. An apparatus as defined in claim 11 wherein said drive rods of the outer circle are operatively connected to a stationary cam via a lever system.

13. An apparatus as defined in claim 9 wherein at least two heaters are fixed to swing arms mounted on said stationary shaft at a position below said carrier elements, said heaters being driven to pivot back and forth through a given sector and being displaced from each other at an angle which is an integral multiple of $360°/n$, where $n$ is the number of processing stations.

14. An apparatus as defined in claim 13 wherein there are two swing arms displaced at an angle of 180° with respect to each other.

15. An apparatus as defined in claim 11 wherein the cams for the cam driven rods comprise two concentric rings having upper end surfaces forming the drive surfaces for followers which are mounted on said drive rods, said followers being biased against said drive surfaces.

16. An apparatus as defined in claim 9 wherein said carrier elements are mandrels suspended in said upper tier, said mandrels include supply conduits for the product to be introduced into the container blank once it has the bottom fitted thereon.

17. An apparatus as defined in claim 9 wherein drive means include two externally toothed drive wheels freely rotatably mounted on said stationary shaft, said carrier elements include mandrels mounted on one drive wheel, and drive rods are mounted on the other drive wheel so that both mandrels and drive rods are entrained by the rotation of said drive wheels.

18. An apparatus as defined in claim 17 wherein an internally toothed ring is rigidly connected to the lower drive wheel, and a pinion drives an eccentric through the action of said internally toothed ring, said eccentric being effective to drive the longitudinal seam welding means and to execute an oscillatory motion to the heating means for preheating the container bottom and lid.

19. An apparatus as defined in claim 18 wherein said longitudinal seam welding means is coupled to a stationary cam via a lever system to effect periodic movement of said welding means in the radial direction against the mandrel holding said folded container blank during the oscillatory motion of said welding device about said common shaft.

20. An apparatus as defined in claim 9 wherein gripper means support the filled container while the lid is being disposed on said wall section, said gripper means being driven by stationary cam to pivot against the container and move away therefrom after effecting said lid fitting operation.

21. An apparatus as defined in claim 20 wherein each gripper means has two opposite faces having a shape corresponding to that of the container blank so that each gripper means can work with either of its two neighboring gripper means.

22. An apparatus as defined in claim 9 wherein two pressure rollers located in the path of the carrier means are effective to shape the container blank wall section about said carrier means, said pressure rollers being pulled toward each other by a biasing means, said carrier means includes suction cups disposed thereon to hold the shaped container wall section against the carrier element.

23. An apparatus as defined in claim 22 wherein said pressure rollers include a flexible covering at least in the region registered with the suction cups on said carrier element.

24. An apparatus as defined in claim 9 wherein a means for feeding a blank to form said bottom and said lid, said feeding means being disposed adjacent said lid and bottom forming means, said feeding means including a feed head connected to a vacuum line and having suction ports thereon, said feed head being positioned in the path of a fitting head disposed on said apparatus so that the trailing edge of said fitting head strips the bottom or lid blank from said feed head.

* * * * *